US006052044A

United States Patent [19]

Aves

[11] Patent Number: 6,052,044

[45] Date of Patent: Apr. 18, 2000

[54] ELLIPSOIDAL CROSS SECTION RADIO FREQUENCY WAVEGUIDE

[75] Inventor: Donald Aves, Englishtown, N.J.

[73] Assignee: MYAT, Inc., Norwood, N.J.

[21] Appl. No.: 09/049,433

[22] Filed: Mar. 27, 1998

[51] Int. Cl.[7] ..... H01P 3/127

[52] U.S. Cl. ..... 333/239; 333/242; 333/248

[58] Field of Search ..... 333/239, 242, 333/248

[56] References Cited

U.S. PATENT DOCUMENTS

| | | | |
|---|---|---|---|
| 3,188,586 | 6/1965 | Mortin et al. | 333/239 |
| 4,687,884 | 8/1987 | DeHart | 174/130 |
| 5,171,942 | 12/1992 | Powers | 174/129 R |
| 5,418,333 | 5/1995 | Sanders | 174/129 R |
| 5,783,317 | 7/1998 | Mennucci et al. | 333/239 X |

FOREIGN PATENT DOCUMENTS

| | | | |
|---|---|---|---|
| 3019247 | 11/1980 | Germany | 333/239 |
| 104502 | 6/1983 | Japan | 333/239 |

OTHER PUBLICATIONS

Mochizuki, T; et al; "Aluminum Elliptical Waveguide"; *Dainichi–Nippon Cables Review* (Japan); No. 64; Feb. 1979; pp. 53–58.

*Primary Examiner*—Benny Lee

*Attorney, Agent, or Firm*—Milde, Hoffberg & Macklin, LLP

[57] ABSTRACT

A waveguide for high power radio frequency transmission, comprising a tubular member having an ellipsoidal cross section and relatively uniform wall thickness having a ratio of major to minor axes between about 1.5 to 2.0 and a minimum minor axis of about 20 cm.

18 Claims, 7 Drawing Sheets

| Circular Waveguide Specifications | | | | | | | | | | | |
|---|---|---|---|---|---|---|---|---|---|---|---|
| Waveguide Designation | Inside Dimensions, inches | Tolerance, inches | Outside Dimensions, inches | Wall Thickness, inches | Theoretical Attenuation, Lowest to Highest Freq. (dB/100 ft.) (Aluminum Alloy) | Recommended Bandwith for $TE_{11}$ Mode Only | | "Overmoded" Bandwidth for $TE_{11}$ Mode | | Dominant Mode ($TE_{11}$) Cutoff ($f_{co}$) | |
| | | | | | | UHF Chans. | Freq. MHz | UHF Chans. | Freq. MHz | Freq. MHz | Wave-length, inches |
| WC 1800 | 18.000 Diam. | ± .020 | 18.500 Diam. | .250 | .088/.041 | 14-15 | 420/ 480 | 16-36 | 502/ 610 | 384 | 30.71 |
| WC 1600 | 16.000 Diam. | ± .015 | 16.375 Diam. | .190 | .083/.049 | 14-25 | 470/ 540 | 26-49 | 585/ 690 | 432 | 27.30 |
| WC 1500 | 15.000 Diam. | ± .015 | 15.375 Diam. | .190 | .088/.054 | 20-31 | 505/ 575 | 32-57 | 602/ 735 | 461 | 25.59 |
| WC 1400 | 14.000 Diam. | ± .015 | 14.375 Diam. | .190 | .099/.060 | 26-38 | 540/ 615 | 38-66 | 645/ 790 | 494 | 23.88 |
| WC 1300 | 13.000 Diam. | ± .015 | 13.250 Diam. | .125 | .107/.088 | 33-45 | 585/ 660 | 45-74 | 695/ 840 | 532 | 22.18 |
| WC 1150 | 11.500 Diam. | ± .015 | 11.750 Diam. | .125 | .129/.081 | 45-60 | 660/ 750 | 60-83 | 785/ 890 | 601 | 19.62 |

FIG. 4A $$\alpha_c^{\circ} = \frac{0.5603}{a^{3/2}} \times \left[ \frac{\frac{1}{2.38}\left(\frac{f}{f_{co}}\right)^{3/2} + \left(\frac{f}{f_{co}}\right)^{-1/2}}{\sqrt{\left(\frac{f}{f_{co}}\right)^{2} - 1}} \right]$$

Where:

$\alpha_c^{\circ}$ = attenuation in dB/100 ft.

$a$ = radius of waveguide in inches $f$ = operating frequency $f_{co}$ = lower cutoff frequency = $\frac{11803}{3.412a}$

ELLIPSOIDAL CROSS SECTION RADIO FREQUENCY WAVEGUIDE

FIELD OF THE INVENTION

The present invention relates to the field of waveguides, and particularly to the field of waveguides for high power radio frequency broadcast transmissions.

BACKGROUND OF THE INVENTION

Ellipsoid internal cross section waveguides were heretofore known for providing a broadband tuning capability, allowing such a waveguide to accommodate a range of frequencies without substantial power loss or reflection. These, however, have not been practically employed, other than in microwave systems. Rather, in radio frequency systems, for example below 1 GHz, the art teaches the use of circular waveguides, which have good transmission properties at a particular center frequency, including low power loss and reflection ratio, or rectangular waveguides, which accommodate a range of frequencies and have low reflection ratio, but have relatively high power loss.

Typically, such radio frequency waveguides are employed, at least in part, to communicate a high power radio frequency transmission between a base-station amplifier and the antenna. The antenna, in turn, is a tall structure raised off the ground by a tower. The waveguide in such circumstances may therefore subject to substantial wind forces, and, for example, should be able to withstand at least hurricane force winds. Due to the relatively large size of these waveguides, for example, 30–60 cm in diameter, and the large exposed distances, for example 300–500 meters, the wind force and turbulent stresses may be substantial, requiring either a protective sheath or a mechanically reinforced waveguide structure, for waveguides having the rectangular external profiles. Round waveguides, on the other hand, have acceptably low wind resistance, but must be provided in a specific diameter for each intended installation. It is known, therefore, to sheath a rectangular waveguide in a smooth encasement, to provide a dual wall structure.

The known ellipsoidal cross section radar waveguides, e.g., with a 2.84' or 1.37' major axis ID, have substantially smaller projected areas, and thus would inherently present less wind resistance per unit length compared to a rectangular waveguide. These radar waveguides are typically operated at frequencies above 2.0 GHz, and with relatively high power levels primarily in pulse mode operation. In these systems, the ellipsoidal cross section waveguide is typically employed for its advantageous electrical properties, low loss and low reflection ratio, especially when flexed. As such, external wind resistance is not a particular consideration for design and use of these systems for radar and point to point waveguide structures, and typically these waveguides are not exposed to the elements over great distances.

Chu, L. J., "Electromagnetic Waves in Elliptic Hollow Pipes of Metal", Journal of Applied Physics 9:583 (9/1938) discusses electrical performance of elliptical waveguides.

U.S. Pat. Nos. 5,171,942 and 5,418,333 provide an elliptic cross section stranded cable which damps conductor strand vibrations by canceling wind-induced forces.

U.S. Pat. No. 4,687,884 provides a low drag conductor for power transmission lines having a textured outer surface.

It is known, in the field of nautical design, to employ ellipsoidal cross section masts to reduce wind turbulence.

SUMMARY OF THE INVENTION

The present invention therefore provides an ellipsoidal cross section waveguide structure, providing broad band tuned electrical characteristics for frequencies below about 1.0 (GHz, and low external wind resistance. Because of the low external wind resistance as compared to rectangular waveguides, the waveguide construction requires correspondingly less reinforcement or rigidity for a given degree of wind resistance, and therefore a typical installation is more efficient. Because the ellipsoidal waveguide has a broad bandwidth, a single size waveguide may be provided for a relatively wide range of frequencies.

The ellipsoidal structure is provided as a tubular member, which may be divided into sections of suitable length, and joined to form an electrically continuous structure by flanges or other types of interlocking structures. The preferred structures have ratios of major to minor axes of between about 1.5 and 2.0 commonly expressed as a minor to major axis ratio of 0.66 to 0.5. For example, two particularly preferred designs have elliptical cross sections of 16 by 9 inches and 13.25 by 8 inches, respectively, for UHF television transmission systems carrying a modulated radio frequency signal. Such systems typically transmit 100 kW or more as a continuous signal, for example in the 400 MHz (UHF) band.

In order to increase rigidity, the exterior wall of the waveguide may be circumferentially ribbed. Thus, since the waveguide typically is subjected to wind forces as it ascents the tower, the circumferential, or axial, ribs do not cause substantial drag. The exterior profile preferably is provided with a surface configuration which minimizes wind-induced turbulence, such as a smooth or appropriately dimpled or textured surface.

Environmentally exposed waveguides typically are provided with a controlled internal environment, which may be maintained, for example, by a positive internal pressure with dry air. The internal pressure may range from slightly superatmospheric to about 3 psig. In either case, structures are provided to maintain the integrity of the internal airspace and to adapt the pressure to changing environmental conditions. Control over the pressure is especially important for rectangular waveguides, which are subject to ballooning, causing significant changes in electrical properties. Ellipsoidal waveguides, for example reinforced with axially oriented ribs every four feet, are less prone to such pressure-induced variations than rectangular waveguides.

By providing a single cross sectional profile which has both acceptable electrical properties internally, and acceptable aerodynamic properties externally, as well as broad bandwidth capability, an efficient system is provided. Further, by providing an ellipsoidal cross section as compared to a rectangular cross section, the electrical loss is relatively reduced.

The waveguide according to the present invention is distinguished from earlier, smaller ellipsoidal waveguide structures in that they are rigid, intended for relatively high continuous power, e.g., over 100 kW, 1 MW, or higher, and are adapted for relatively lower frequencies, e.g., below 1.0 GHz, as compared to the flexible ellipsoidal waveguides operating at 2.0 GHz in low power microwave or pulse radar, as in prior systems.

As used herein, the term ellipsoid refers to a structure having a wall substantially without major vertices, having a substantially anisotropic cross section. Thus, the ellipsoid cross section excludes both rectangular and round cross sections at the extremes of structures having major vertices and substantially without anisotropic cross section, respectively. Elliptical, other oval, and high order piecewise approximations of oval structures are encompassed by the ellipsoidal structure.

The preferred material for constructing the waveguide is 1100 series aluminum, preferably with H14 temper. See, Aluminum Standards and Data 1979, The Aluminum Association Inc., p 10. Such a waveguide is assembled as a clamshell of two shallow halves, for example by MIG welding. See. Metals Handbook ($8^{th}$ Ed.), American Society for Metals. Vol. 6, "Welding and Brazing", p. 78. The waveguide may also be copper, for example copper alloy 102. See. Metals Handbook ($8^{th}$ Ed.), American Society for Metals. Vol. 6, "Welding and Brazing", p. 78. In order to provide enhanced electrical performance, the inner surface may be coated with a material having a higher conductivity of radio frequency waves than the bulk of the wall material, for example by silver plating the internal surface, in known manner. In the case of aluminum, an intermediate layer, for example of copper, may be used to improve adhesion of the silver.

It is therefore an object according to a preferred embodiment of the present invention to provide a waveguide for high power radio frequency transmission at frequencies below about 1.0 GHz, comprising a tubular member having an ellipsoidal cross section having a ratio of minor to major axes between approximately 0.66 to 0.5 and a minimum minor axis of approximately 20 cm. A particularly preferred ratio of axes is about 0.55–0.61.

It is also an object according to the present invention to provide an oval radio frequency waveguide having structural features, such as ribs, to increase a tubular rigidity thereof.

It is a further object according to the present invention to provide an oval radio frequency waveguide having external surface characteristics, such as a smooth surface or dimples, to reduce a wind resistance or turbulence thereof.

Other objects and advantages of the present invention will become apparent from a review of the drawings and detailed description.

BRIEF DESCRIPTION OF THE DRAWINGS

The preferred embodiments of the invention will be explained by reference to the drawings, in which:

FIGS. 4A, 4B and 4C show, respectively, a chart showing circular waveguide specifications, a formula for circular waveguide performance, and a comparative graph of circular, rectangular and square waveguide performance.

DETAILED DESCRIPTION OF THE PREFERRED EMBODIMENTS

Figure 1A:
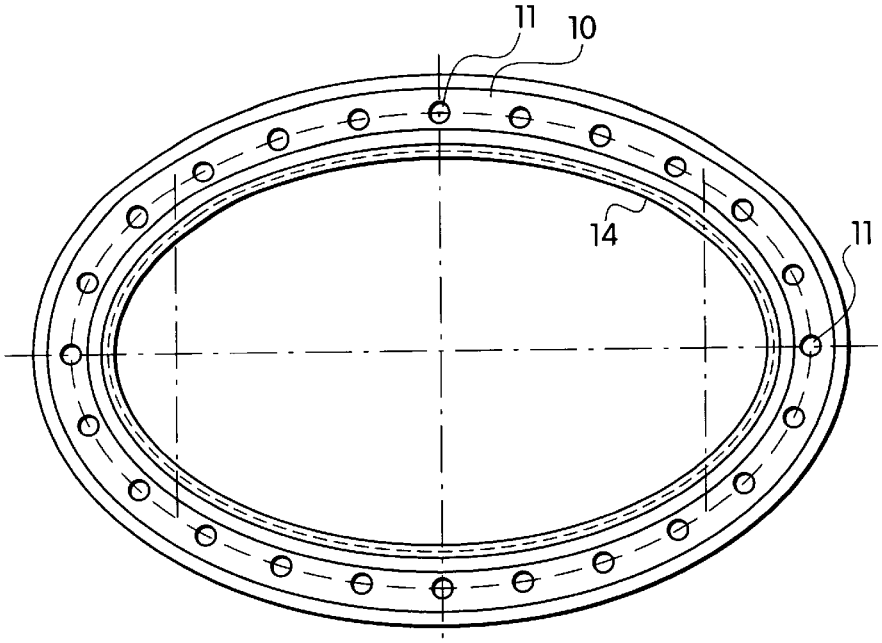
FIGS. 1A, 1B and 1C are respectively an end view of an ellipsoidal waveguide showing a male flanged portion, a cross section of the flange, and a side view thereof

The preferred embodiments of the invention shall now be described with respect to the drawings, where identical reference numerals in the drawings indicate corresponding features.

EXAMPLE 1

A waveguide is formed from 5 gauge (0.187") 1100-H14 alloy aluminum, to form an elliptical cross section having a major axis of 16" and a minor axis of 9". Lengths are selected, based on the operating frequency, to be about, 4 meters each. Typically, at the upper end of the UHF-TV spectrum, two different provided lengths of 143⅝" and 138" are sufficient for most applications. The sheet is welded into the hollow shape from two shallow halves (welds on major dimension), leaving the minor axis smooth. Flanges are welded on each end, having a male and female type, respectively, with a thin rubber gasket outside the waveguide region. The male waveguide portion has a contact surface near the waveguide region to maintain the electrical energy within the waveguide at the junction. The female flange surface is flat. The flanged sections are held in place with shoulder bolts nuts.

EXAMPLE 2

A waveguide is formed from 8 gauge (0.125") 1100-H14 alloy aluminum, to form an ellipsoid cross section having a major axis of 13.25" and a minor axis of 8". Lengths are selected, based on the operating frequency, to be about, 4 meters each. Typically, at the upper end of the UHF-TV spectrum, two different provided lengths of 143⅝" and 138" are sufficient for most applications. The sheet is welded into the hollow shape from two shallow halves (welds on major dimension), leaving the minor axis smooth. Flanges are welded on each end, having a male and female type, respectively, with a thin rubber gasket outside the waveguide region. The inner surface of the waveguide is plated with silver 14, as shown in FIG. 1A. The male waveguide portion has a contact surface near the waveguide region to maintain the electrical energy within the waveguide at the junction. The female flange surface is flat. The flanged sections are held in place with shoulder bolts and nuts. The outer surface 15 of the waveguide is smooth, representing the outer surface of the formed aluminum sheet as shown in FIG. 1C.

Figure 1B:
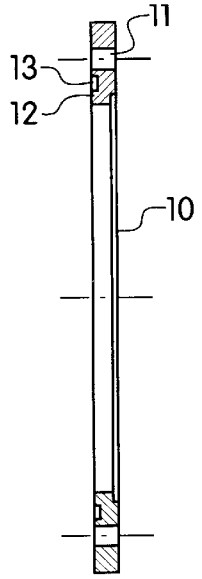
Figure 1C:
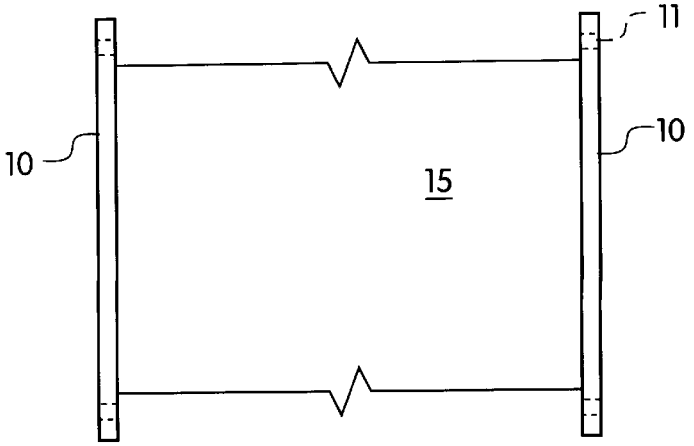

As shown in FIGS. 1A, 1B and 1C, the end-flange 10 provides a flat surface for joining adjacent sections of waveguide. The waveguide sections are held together with shoulder bolts and nuts, not shown, which pass through holes 11. A ridge 12 (see FIG. 1B) provides electrical contact with an adjacent flat flanged surface. A rubber gasket sits in groove 13 (see FIG. 1B) to seal the interior space.

Figure 2:
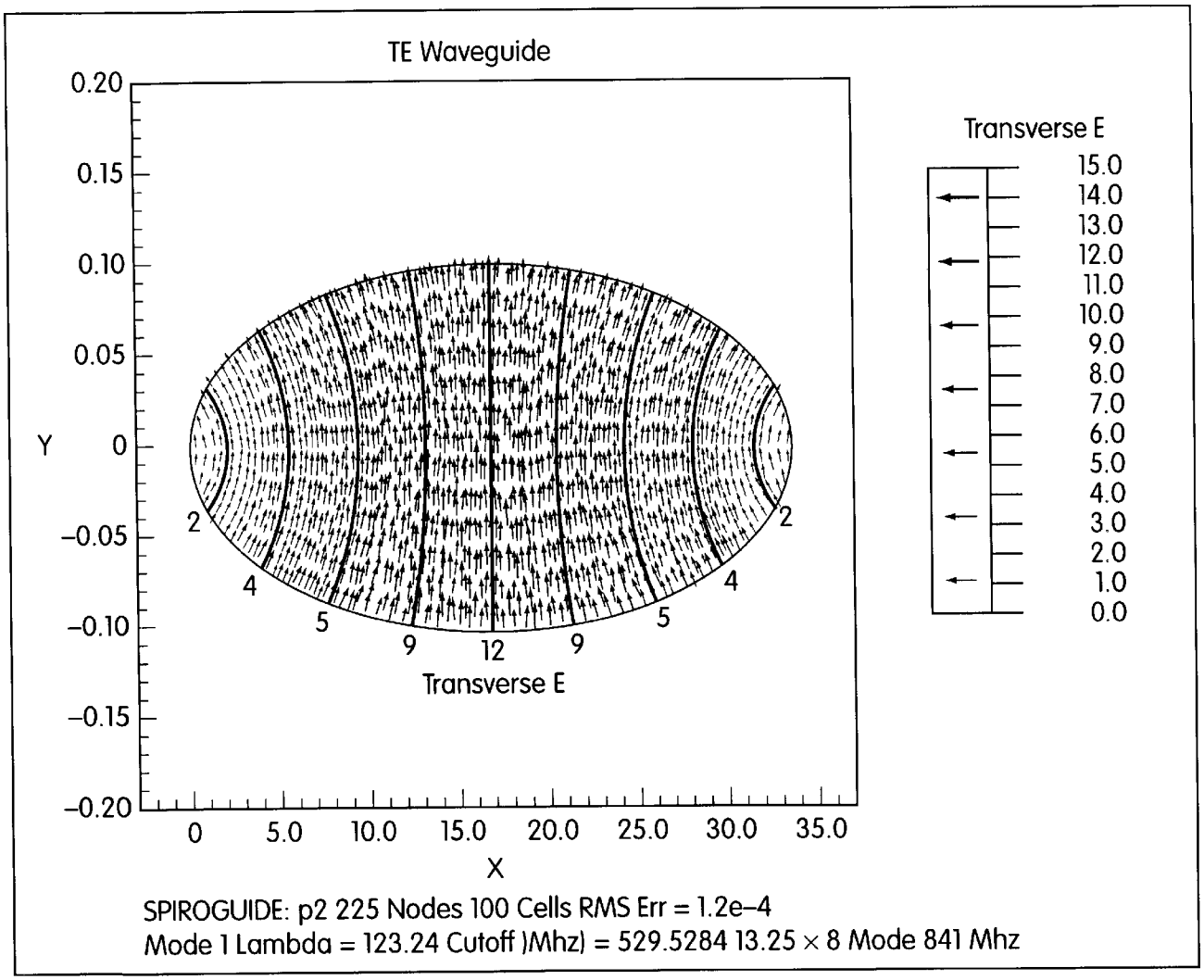
FIG. 2 shows an Eigen function computer analysis of electrical field vectors inside an elliptical waveguide structure according to the present invention, including isopotential lines showing transverse E field strength.

As shown in FIG. 2, the elliptical waveguide distributes most of the electrical energy over the central two thirds along the major axis, with no particular focus of energy density. The energy density, as well as both longitudinal and transverse E fields, near the ends of the major axis are small, making the sensitivity to weld imperfections at the areas of minimum curvature radius low. The quantitative change in electrical fields with variation in frequency is small, making the ellipsoidal waveguide suitable for delivering a relatively broad bandwidth modulated radio frequency signal.

Figure 3:
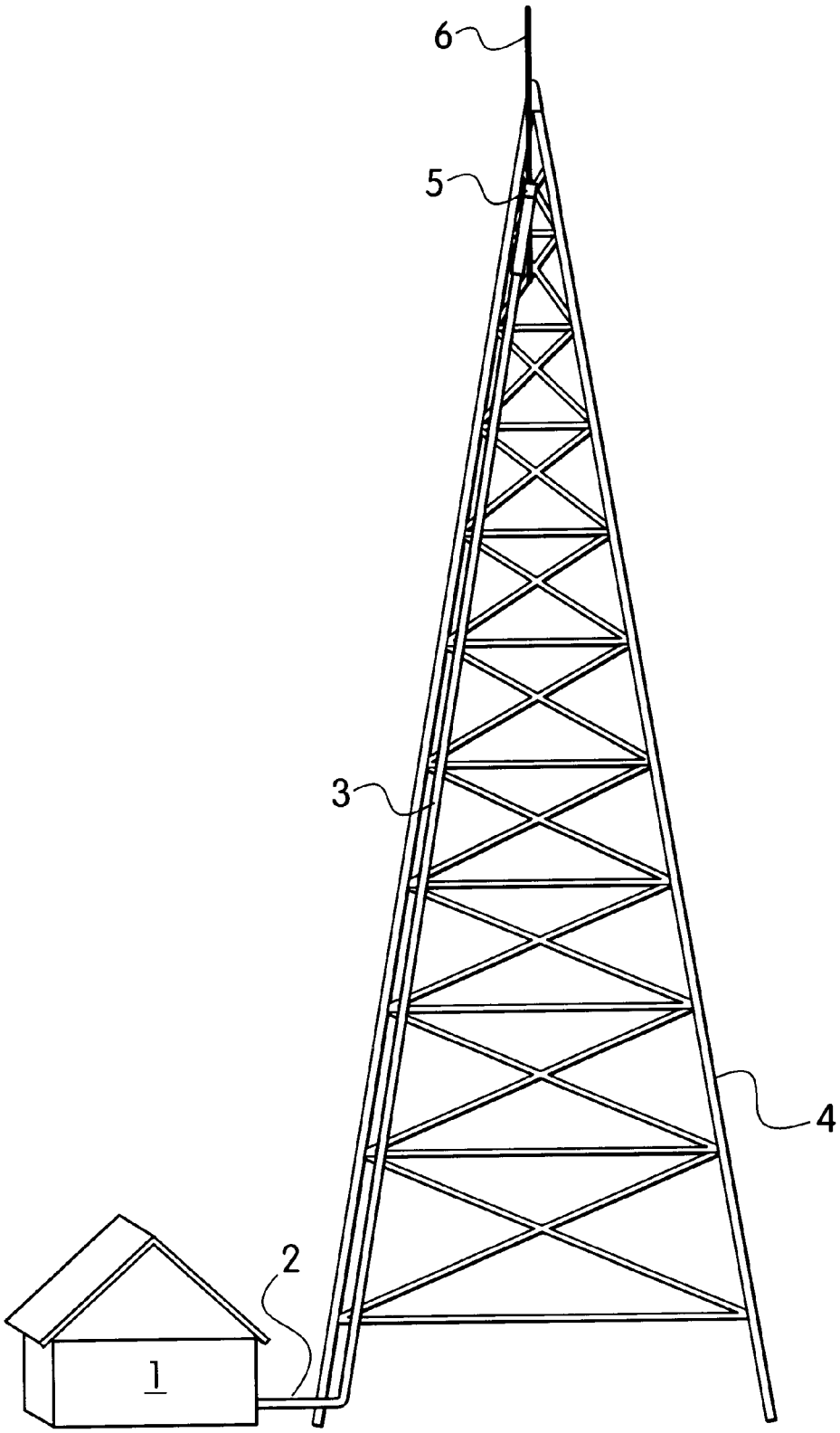
FIG. 3 shows a schematic illustration of a waveguide leading up a broadcast antenna.

As shown in FIG. 3, a base station 1 generates a high power radio frequency signal, which is transmitted through a waveguide 2. An upwardly extending portion of the waveguide 3 continuous with the horizontal portion of the waveguide 2,". extends up a tower 4, where the radio frequency signal is coupled by a coupler 5 to an antenna 6. The coupler 5 is, for example, formed of a first section having an elliptical to rectangular waveguide transition and a second section having a rectangular to coaxial waveguide transition for coupling to the antenna 6. Over the course of the upwardly extending waveguide 3 path, the waveguide may be subjected to substantial wind forces.

Figure 4B:
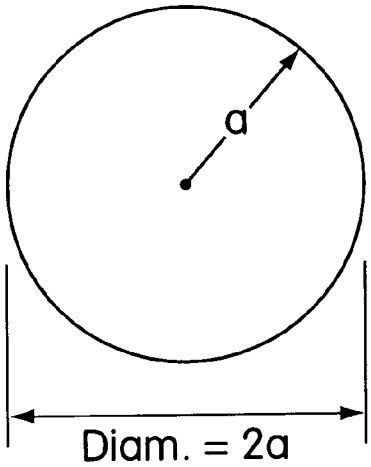
Figure 4C:
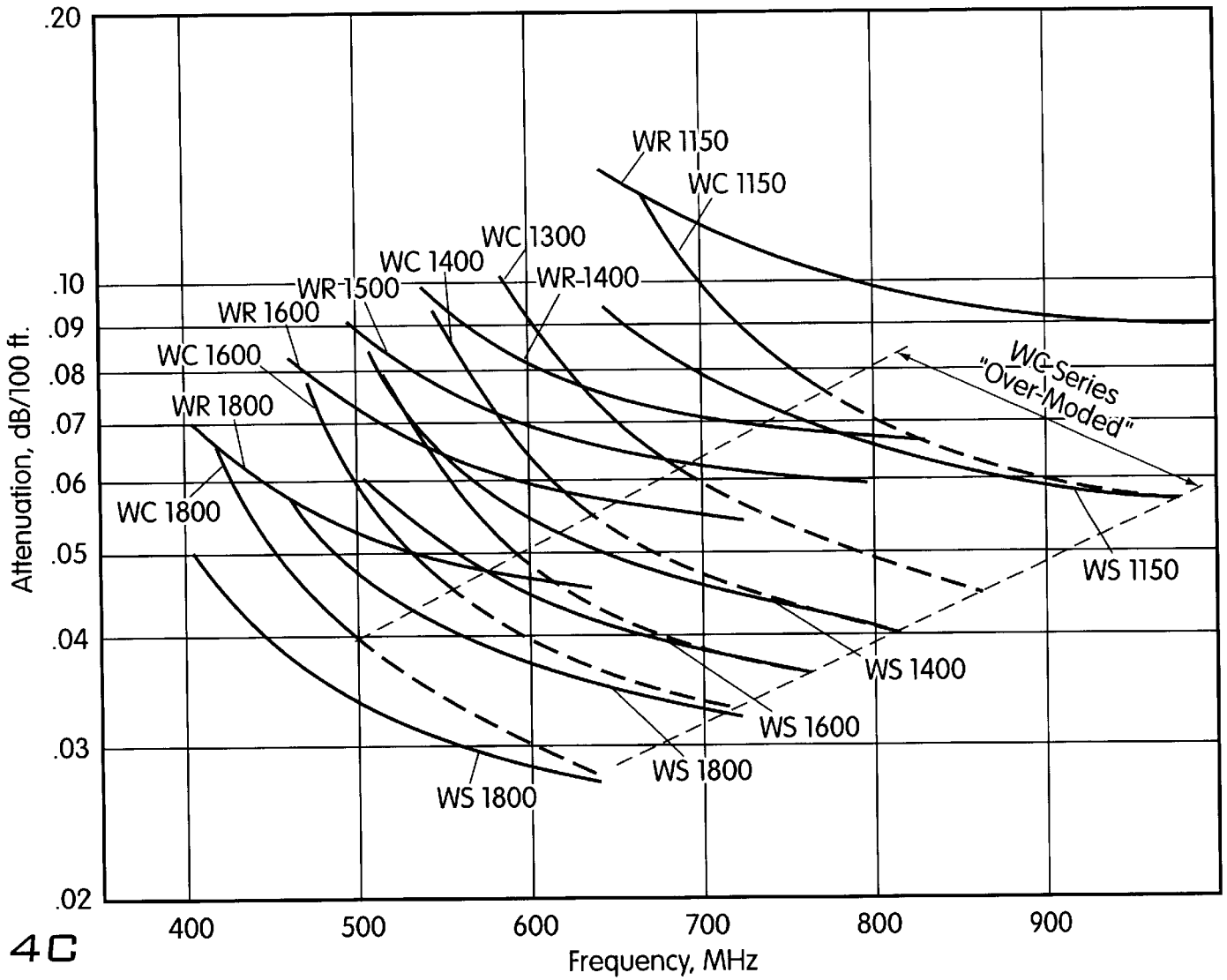

FIG. 4A shows specifications for circular waveguides, with an appropriate frequency range for each of six available sizes for covering the UHF-TV band. As can be seen, larger dimensioned waveguides are more appropriate for lower frequency (longer wavelength) signals, while smaller dimensioned waveguides are more appropriate for higher frequency (shorter wavelength) signals. FIG. 4B shows a formula for determining attenuation of circular waveguides. The formula of FIG. 4B demonstrates a somewhat complex relationship of attenuation and waveguide circular radius, operating frequency and lower cutoff frequency, with empirically derived coefficiencts for series 1100 aluminum alloys. FIG. 4C shows a comparison of circular, rectangular and square waveguides. Data is provided over the UHF range for 5 rectangular or square waveguides, the rectangular WR 1800, WR 1600, WR 1500, WR 1400, and WR 1150 and the square WS 1800, WS 1600, WS 1500, WS 1400, and WR 1150, and 6 circular WC 1800, WC 1600, WC 1500, WC 1400, WC 1300, and WC 1150, with the rectangular waveguides having better equalization. As can be seen, the bandwidth of rectangular waveguides is broader than circular or square waveguides. Ellipsoidal waveguides have similar bandwidth to comparable rectangular waveguides. Therefore, fewer sizes are necessary to encompass the band, and any selected size is more tolerant to slight variations in design, manufacture and operating conditions. Therefore, for the upper UHF-TV band, e.g., channels 25–60, three circular waveguide sizes are employed, while only two rectangular or ellipsoidal sizes are required, e.g., the designs according to Examples 1 and 2.

Figure 5:
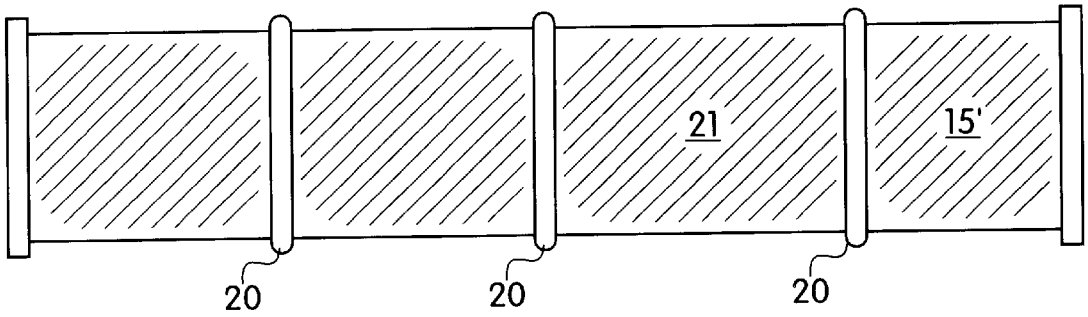
FIG. 5 shows a side view of an embodiment of the ellipsoidal waveguide according to the present invention having a textured surface and support ribs.

The designs of Examples 1 and 2 exhibit less wind resistance than corresponding rectangular waveguide structures designed for the same power and operational frequencies, and therefore have correspondingly improved mechanical performance over rectangular waveguides and lower weight per unit length as compared to double wall waveguide structures. Electrical performance of the ellipsoidal waveguides shows a broad bandwidth characteristic. FIG. 5 shows a modified embodiment of the configuration according to Examples 1 and 2. The inner surface of the waveguide (not shown in FIG. 5) is unaltered, therefore the electrical performance will be very similar. The outer surface, however, is modified by the addition of ribs 20, formed circumferentially around the waveguide. In addition, the outer surface is shown with texturing material 21 applied to the surface 15', with a surface configuration to reduce wind drag, provided in known manner.

It should be understood that the preferred embodiments and examples described herein are for illustrative purposes only and are not to be construed as limiting the scope of the present invention, which is properly delineated only in the appended claims.

What is claimed is:

1. A waveguide for high power radio frequency transmission at frequencies below about 1.0 GHz, comprising a tubular member having an ellipsoidal cross section having a ratio of minor to major axes between approximately 0.66 to 0.5 and a minimum minor axis of approximately 20 cm.

2. The waveguide according to claim 1 wherein said waveguide has axially oriented ribs, said ribs providing increased tubular rigidity.

3. The waveguide according to claim 1, wherein said tubular member has a major axis of approximately 16 inches and a minor axis of approximately 9 inches.

4. The waveguide according to claim 1, wherein said tubular member has a major axis of approximately 13.25 inches and a minor axis of approximately 8 inches.

5. The waveguide according to claim 1, wherein said waveguide is adapted for delivery of radio frequency energy to an antenna.

6. The waveguide according to claim 1, wherein said waveguide is adapted for delivery of television band radio frequency energy to an antenna.

7. The waveguide according to claim 1, wherein said waveguide is adapted for delivery of at least 100 kW of modulated radio frequency energy to an antenna.

8. The waveguide according to claim 1, wherein said waveguide is adapted for delivery of at least 1 MW of modulated radio frequency energy to an antenna.

9. The waveguide according to claim 1, wherein said waveguide is adapted to withstand environmental exposure.

10. The waveguide according to claim 1, wherein said waveguide has an external wall, said external wall being smooth.

11. The waveguide according to claim 1, wherein said waveguide has an external wall, said external wall being textured.

12. The waveguide according to claim 1, wherein said waveguide has a single wall having a uniform average wall thickness.

13. The waveguide according to claim 1, wherein said tubular member of said waveguide is comprised of 1100 series aluminum alloy.

14. The waveguide according to claim 1, wherein said tubular member of said waveguide is comprised of 1100-H14 aluminum alloy.

15. The waveguide according to claim 1, wherein said tubular member of said waveguide is comprised of copper 102 alloy.

16. The waveguide according to claim 1, wherein said tubular member comprises a waveguide wall and said waveguide comprises an inner surface having a radio frequency electrical conductivity greater than a radio frequency electrical conductivity of a bulk of said waveguide wall.

17. The waveguide according to claim 1, wherein said waveguide comprises an internal silver plating.

18. A waveguide for radio frequency transmission capable of transmitting an average power of at least 100.000 Watts, for a signal having a frequency of below about 1.0 GHz, comprising a tubular uniform single wall member having an ellipsoidal cross section having a ratio of minor to major axes of between approximately 0.66 to 0.5 and a minimum minor axis of approximately 8 inches, wherein a wind drag on an external surface of the tubular uniform single wall member is less than a wind drag of a rectangular waveguide having a corresponding minor to major axis ratio.

* * * * *